United States Patent [19]

Winick

[11] Patent Number: 4,575,712

[45] Date of Patent: Mar. 11, 1986

[54] COMMUNICATION SYSTEM

[75] Inventor: Steven J. Winick, Woodmere, N.Y.

[73] Assignee: Pittway Corporation, Syosset, N.Y.

[21] Appl. No.: 583,827

[22] Filed: Feb. 27, 1984

[51] Int. Cl.[4] ..... G08B 1/08

[52] U.S. Cl. ..... 340/539; 340/531; 340/536; 340/346; 455/9

[58] Field of Search ..... 340/539, 506, 531, 536, 340/345, 346; 455/9, 67, 115, 229

[56] References Cited

U.S. PATENT DOCUMENTS

| | | | |
|---|---|---|---|
| 4,056,815 | 11/1977 | Anderson | 340/539 |
| 4,101,872 | 7/1978 | Pappas | 340/539 |
| 4,259,663 | 3/1981 | Gable | 340/147 |
| 4,271,523 | 6/1981 | Gable | 371/57 |
| 4,287,592 | 9/1981 | Paulish et al. | 370/88 |
| 4,308,613 | 12/1981 | Chasek | 370/94 |
| 4,320,508 | 3/1982 | Takezoe | 371/22 |
| 4,347,501 | 8/1982 | Akerberg | 340/531 |
| 4,442,426 | 4/1984 | Heuschmann et al. | 340/539 |

FOREIGN PATENT DOCUMENTS

| | | | |
|---|---|---|---|
| 0069470 | 1/1983 | European Pat. Off. . | |
| 2060965 | 5/1981 | United Kingdom | 340/539 |

*Primary Examiner*—Donnie L. Crosland

[57] ABSTRACT

A communication system includes a common receiver unit and a plurality of satellite transmitter units remote from the receiver unit. Each transmitter unit has a logic section and a transmitter section, and each transmitter unit is switchable between a standby mode in which no message is to be sent to the receiver unit and an active mode in which a message is to be sent to the receiver unit. The logic section generates status messages and data messages, the format of the status message including an address portion identifying the transmitter unit and an indicator portion shiftable between first and second values. During a standby mode, the transmitter unit periodically and repetitively generates status messages in which the indicator portion is set to the first value, and only during an active mode of the transmitter unit when the transmitter section is sending a message to the receiver unit, the indicator portion of the status message is switched to the second value.

11 Claims, 4 Drawing Figures

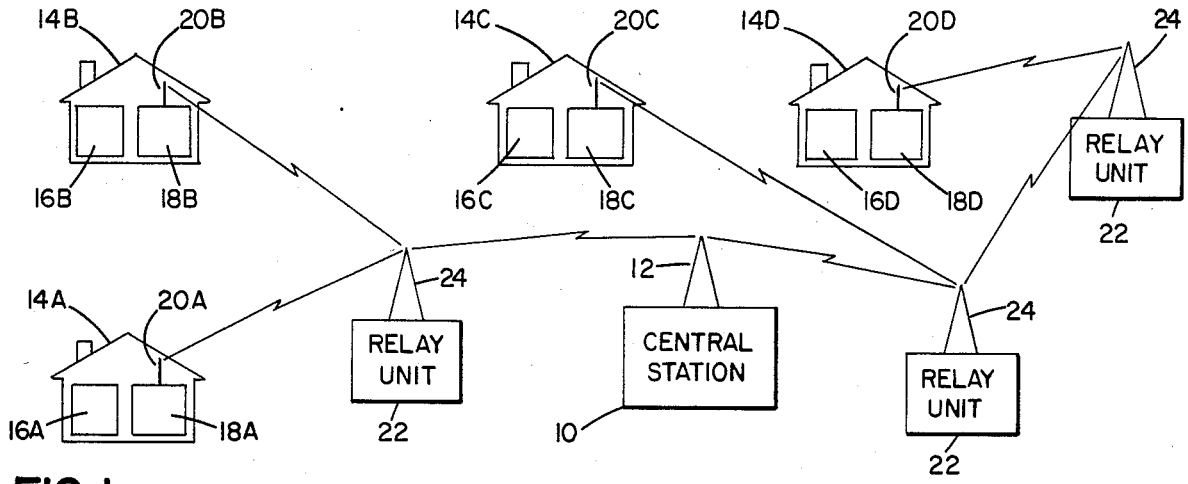
FIG 1
FIG 2
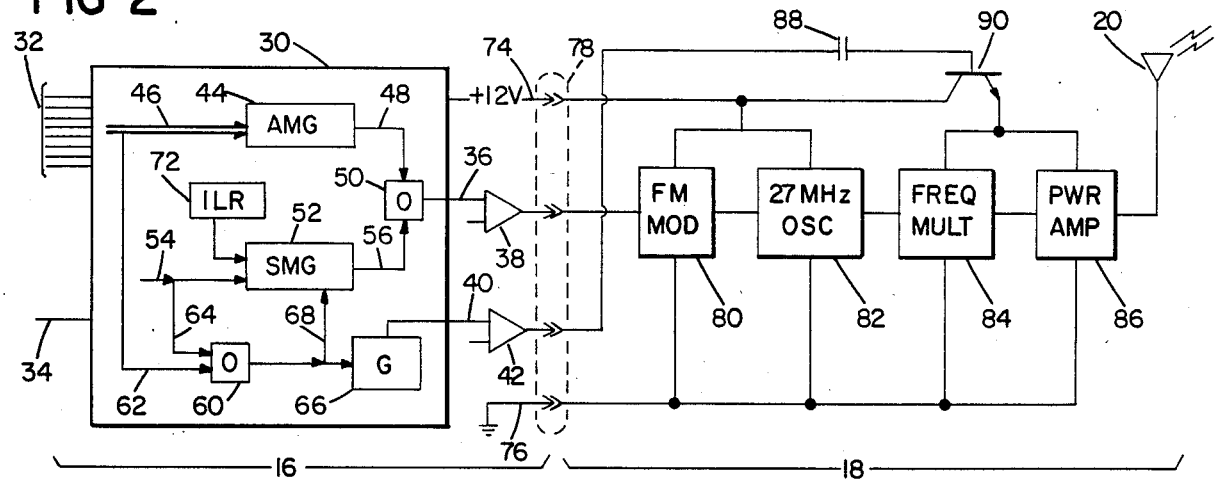
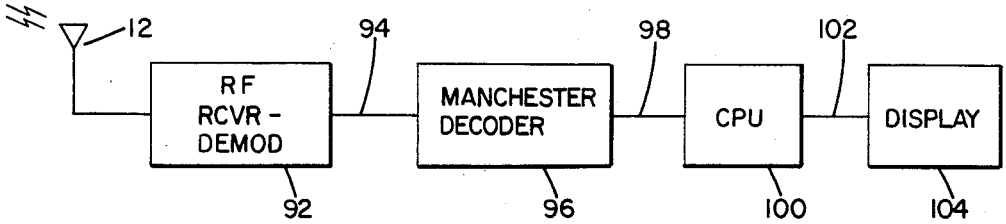
FIG 3
FIG 4
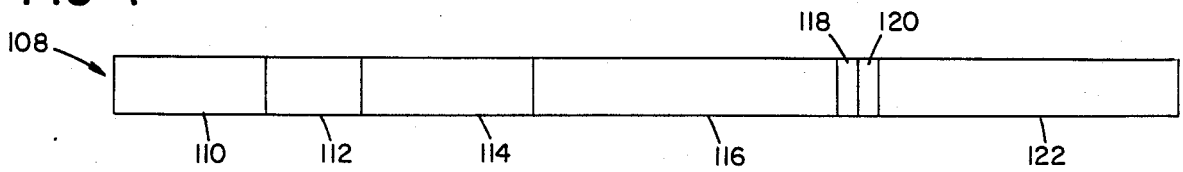

COMMUNICATION SYSTEM

This invention relates to communication systems, and more particularly to communication systems of the type that employ a common receiver unit and a plurality of satellite transmitter units remote from the receiver unit.

The transmitters in such a communication system may, for example, monitor conditions at the remote transmitter sites, and periodically transmit messages indicative of the conditions at the monitored site. Transmitters in such systems may have both control (logical) functions and transmitting functions, but without feedback from the transmitting function to the control function to insure proper operation, so that it is possible for the transmitting function to operate improperly and independently of the control function. During such intervals of improper operation, the control function does not know that the transmitting function is operating, and the transmitting function will only be transmitting raw carrier, since the control function will not be providing any of the data that it would provide under proper operating circumstances. An example of such a system is a communication radio system which has monitor and transmitter equipment at subscriber locations that monitor zones of protection at the subscriber location, and transmit alarm indications to central station equipment by radio. In such systems, the transmitters operate asynchronously to periodically transmit status indications that confirm or verify the transmitting equipment is in operating condition. In a system with a large number of satellite transmitter units that are monitored by a central station, a transmitter unit may, during a fault condition, transmit only raw carrier. The result of such a fault condition is that the transmission frequency is jammed, with the central station equipment unable to identify which transmitter is failed, without going through a process such as triangulation or directional antenna technique to identify the faulty transmitter.

In accordance with the invention, there is provided a communication system that includes a common receiver unit and a plurality of satellite (subscriber) transmitter units remote from the receiver unit. Each transmitter unit comprising a logic section and a transmitter section that includes an output stage coupled to an output means for transmitting messages to the common receiver unit, and each transmitter unit is switchable between a standby mode in which no message is to be sent to the receiver unit and an active mode in which a message is to be sent to the receiver unit. The logic section includes means to generate status messages and data messages, the format of the status message including an address portion identifying the transmitter unit and an indicator portion shiftable between first and second values. Means operative during the standby mode of the transmitter unit periodically and repetitively generates status messages in which the indicator portion is set to the first value, and means operative only during the active mode of the transmitter unit enables the transmitter section for sending a message to the receiver unit. Means also operative during the active mode concurrently switches the indicator portion of the status message to the second value. Signals transmitted by the transmitter unit due to system faults during standby mode include status messages with the indicator portion having the first value, thus providing an indication of the fault condition and an identification of the faulty transmitter unit. The system insures that should the transmitting function fail and operate under circumstances when it should not, it will transmit transmitter identification and fault indication information. Effectively the transmitted message says "If you can hear this transmission, I am transmitter number 1234 and I should not be transmitting at this time".

In a particular embodiment, the transmitter unit is of the radio type and operates at a frequency greater than one megahertz and its transmitter section includes an RF modulator stage of the FM type and an output stage, and the means operative during the active mode applies power to the output stage to energize the transmitter section for sending a message to the receiver unit. The logic section of the transmitter unit includes a plurality of alarm inputs, and means responsive to an alarm signal on one of the alarm inputs places the transmitter unit in the active mode. Also, the indicator portion of the status message is a single bit.

Other features and advantages will be seen as the following description of a particular embodiment progresses, in conjunction with the drawing, in which:

FIG. 1 is a diagram of a long range radio system that incorporates the invention;

FIG. 2 is a block diagram of a logic transmitter unit of the system of FIG. 1;

FIG. 3 is a block diagram of central station equipment employed in the system of FIG. 1; and FIG. 4 is a diagram of a status message employed in the system of FIG. 1.

DESCRIPTION OF PARTICULAR EMBODIMENT

The system shown in FIG. 1 includes central station 10 that has receiving antenna 12; subscriber equipment locations 14A–14D, each of which includes a logic section 16 and a nine-hundred megahertz transmitter section 18 that has a three watt nominal output and can be mounted with or separate from transmitting antenna 20; and relay units 22 each of which has an associated antenna 24. The system handles up to sixteen thousand subscribers 14 and transmitter sections 18 have a twenty-five mile range. Transmitters 18 provide status and alarm messages.

Further details of the logic and transmitter equipment at each subscriber location may be seen with reference to FIG. 2. Logic section 16 receives power at twelve volts DC from the control panel and provides eight zones of protection, each protection zone being programmable to respond to a normally open circuit, a normally closed circuit, voltage activated signals, etc. Each logic section 16 includes a central processing unit (CPU) 30 that receives alarm signals over lines 32 from up to eight sensors at the subscriber site 14 and an auxiliary input over line 34. CPU 30 preferably includes a microprocessor and includes signal generating circuitry of the type disclosed in European Patent Application No. 69470 published Jan. 12, 1983 in the name of the assignee of this application, the disclosure of which is incorporated herein by reference. CPU 30 generates multibit messages at a 2400 baud rate for transmission on line 36 through amplifier 38 and gating signals on line 40 through amplifier 42.

As indicated diagrammatically in FIG. 2, CPU 30, in part, includes alarm message generator (AMG) 44 which responds to alarm signals on lines 46 from alarm inputs 32 and produces serial alarm message data trains on line 48 which are passed through OR logic 50 for application to line 36; and status message generator (SMG) 52 which responds to a periodically generated status message trigger signal on line 54 and produces a serial status message data train output on line 56 for application through OR logic 50 to line 36. In addition, CPU 30 includes OR logic 60 which has an input on line 62 in response to each alarm signal, a second input on line 62 in response to each trigger signal, and produces an output that triggers generator 66 to generate a gating signal on line 40. The output of OR logic 60 is also applied to status message generator 52 to set an "OK" bit stage in the message generator 52 which remains set as long as the gating interval signal on line 40 is present. In addition, CPU 30 includes an "idle loop" routine (ILR-diagrammatically indicated at 72) that periodically triggers status message generator 52 to supply a status message data train over line 56 for application to RF transmitter section 18. During this idle loop routine, however, the "status OK" signal on line 68 is not generated and each generated serial status message train includes a cleared ("I'm not OK") status indication.

The signals on line 36 and 40, together with a twelve volt signal on line 74 and system ground on line 76, are applied through interface 78 to the RF transmitter section 18 that includes FM modulator 80, twenty-seven megahertz oscillator 82, a 36× multiplier 84 and power output stage 86 for application to antenna 20. Serial message trains on line 36 are applied to modulator 80; the gating signal on line 40 is applied through capacitor 88 to control transistor 90; and the twelve volt power on line 74 is applied continuously to modulator stage 80, to oscillator stage 82 and to the collector of control transistor 90. In response to a gating signal on line 40, transistor 90 turns on for a gating interval of about eighty milliseconds to apply power to multiplier stage 84 and power output stage 86.

Details of equipment at central station 10 may be seen with reference to FIG. 3. That equipment includes an RF receiver-demodulator stage 92 connected to antenna 12 which applies the demodulated audio signal over lines 94 to Manchester decoder 96 which converts the demodulated audio signal to data bits and applies them over lines 98 to CPU 100 which assembles messages from the data bits and generates an output over line 102 for application to display 104 or other appropriate output device.

The configuration of a status message 108 is indicated in FIG. 4. Each status message 108 has an eight bit preamble 110 which indicates the start of a message; a five bit message type section 112 that identifies the message type (a status message having fifty-six bits while an alarm message has ninety bits); a nine bit channel identification section 114 which identifies the frequency and geographic location of the transmitter; a sixteen bit account information section 116 which provides customer identification; auxiliary bit 118; normally cleared (that is, "Not OK" ) bit 120; and a sixteen bit error check section 122. CPU 30 includes an alarm message generator 100, a status message generator 102, and a gating signal generator 104. CPU 30 includes an "idle loop" routine that regularly applies a status message over line 36 to FM modulator 80. The only exception is when an alarm message is to be sent in response to signal on line 32 or 34. The CPU 30 periodically generates this status message with the indicator bit 120 cleared ("I'm not OK") in an "idle loop" routine (for example every second). No signal is transmitted as power is not applied to the power output stage 86.

As indicated above, CPU 30 includes idle loop routine 70 that periodically (for example every second) causes CPU 30 to generate a status message with the indicator bit 120 cleared. During this "idle loop" routine interval, no gating signal is generated on line 40, and therefore transistor 90 is not turned on and power is not applied to output stage 86.

When an "I'm OK" status indication is to be transmitted by a transmitter site 14 (for example every fifteen minutes) to verify to central station 10 that that transmitter site 14 is "alive", a trigger signal is asserted on line 54 to interrupt the "idle loop" routine 72 and trigger status message generator 52 to generate a status message data train on line 56. The trigger signal on line 54 is also passed on line 64 through OR logic 60 and that logic's output on line 68 changes the indicator (status) bit 120 from zero to one, so that the generated status message includes a "status OK" indication concurrently with the assertion of the gating interval by generator 66 on line 40 which turns on transistor 90 to apply power to multiplier stage 84 and output stage 86. Modulator 80 and oscillator 82 are always powered (warm) so that the transmitter 18 is in condition to transmit status or alarm messages without transient.

Thus, in response to a signal from CPU 30 to apply power to output stage 86, CPU 30 also switches the "OK" bit 120 of the status message generator 52. In the event of component failure so that the power output stage 86 is powered and an unmodulated signal is applied to transmitter antenna 20, (failure in the gating circuit, for example), the transmitter 18 will periodically transmit a "status NOT OK" indication in the form of a status message with the station identification of message sections 114, 116 as well as the "NOT OK" identification of cleared bit 120 so that the central station 10 may immediately identify the defective transmitter and corrective action may be promptly taken.

While a particular embodiment of the invention has been shown and described, various modifications will be apparent to those skilled in the art, and therefore it is not intended that the invention be limited to the disclosed embodiment or to details thereof, and departures may be made therefrom within the spirit and scope of the invention.

What is claimed is:

1. In a communication system that includes a common receiver unit and a plurality of satellite transmitter units remote from said receiver unit, each said transmitter unit comprising a logic section and a transmitter section that includes an output stage coupled to an output means for transmitting messages to a common receiver unit, each said transmitter unit being switchable between a standby mode in which no message is intended to be sent to said receiver unit and an active mode in which a message is intended to be sent to said receiver unit, said logic section including means to generate status messages and data messages, the format of each said status message including an address portion identifying the transmitter unit and an indicator portion shiftable between first and second values, means operative during said standby mode for repetitively generating status messages in which said indicator portion is set to said first value, means operative only during said active mode for enabling said transmitter section for sending a message to said receiver unit, and means operative during said active mode for concurrently switching said indicator portion of said status message to said second value when the message to be transmitted is a status message.

2. The communication system of claim 1 wherein said transmitter unit transmitter section includes an RF modulator stage and an output stage, and said means operative during said active mode applies power to said output stage to energize said transmitter section for sending a message to said receiver unit.

3. The communication system of claim 2 wherein said RF modulator is of the FM type.

4. The communication system of claim 1 wherein said indicator portion of said status message is a single bit.

5. The communication system of claim 1 wherein said transmitter unit is of the radio type and operates at a frequency greater than one megahertz.

6. The communication system of claim 1 wherein said means operative only during said active mode for enabling said transmitter section for sending a message to said receiver unit includes a power transistor connected to control the application of power to said output stage, and AC coupling means for applying a gating signal to said power transistor.

7. The communication system of claim 6 wherein said transmitter unit is of the radio type and operates at a frequency greater than one megahertz.

8. The communication system of claim 7 wherein said transmitter unit transmitter section includes an RF modulator stage and an output stage, and said means operative during said active mode applies power to said output stage to energize said transmitter section for sending a message to said receiver unit.

9. The communication system of claim 1 wherein said logic section includes a plurality of alarm inputs, and means responsive to an alarm signal on one of said alarm inputs for placing said transmitter unit in said active mode.

10. The communication system of claim 9 wherein said indicator portion of said status message is a single bit, said means operative during said standby mode for repetitively generating status messages in which said indicator bit is set to said first value includes an idle loop routine, and said means operative during said active mode switches said indicator bit to to said second value.

11. The communication system of claim 10 wherein said transmitter unit is of the radio type and operates at a broadcast frequency greater than one megahertz, said transmitter section including an RF modulator stage and an output stage, and said means operative during said active mode including a power switch connected to control the application of power to said output stage and AC coupling means for applying gating signals to said power switch to apply power to said output stage for sending messages to said receiver unit.

* * * * *